US010094189B2

(12) United States Patent
Kartha et al.

(10) Patent No.: US 10,094,189 B2
(45) Date of Patent: Oct. 9, 2018

(54) CONSTANT FORCE DOWNHOLE ANCHOR TOOL

(71) Applicant: HALLIBURTON ENERGY SERVICES, INC., Houston, TX (US)

(72) Inventors: Nikhil M. Kartha, Singapore (SG); Mark S. Holly, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 189 days.

(21) Appl. No.: 15/310,443

(22) PCT Filed: Jun. 10, 2014

(86) PCT No.: PCT/US2014/041683
§ 371 (c)(1),
(2) Date: Nov. 10, 2016

(87) PCT Pub. No.: WO2015/191042
PCT Pub. Date: Dec. 17, 2015

(65) Prior Publication Data

US 2017/0074062 A1 Mar. 16, 2017

(51) Int. Cl.
*E21B 23/01* (2006.01)
*E21B 23/04* (2006.01)

(52) U.S. Cl.
CPC ..... *E21B 23/01* (2013.01); *E21B 23/04* (2013.01)

(58) Field of Classification Search
CPC ..... E21B 23/01; E21B 23/04
See application file for complete search history.

(56) References Cited

U.S. PATENT DOCUMENTS

| | | | | |
|---|---|---|---|---|
| 7,249,918 | B1 | 7/2007 | Bowman | |
| 7,370,703 | B2 | 5/2008 | Hill et al. | |
| 2011/0073326 | A1 | 3/2011 | Clemens et al. | |
| 2011/0100648 | A1 | 5/2011 | Reid | |
| 2011/0146970 | A1 | 6/2011 | Hallundbeak et al. | |
| 2011/0277990 | A1* | 11/2011 | Kotsonis | E21B 4/18 166/217 |
| 2012/0168176 | A1 | 7/2012 | Aguirre et al. | |
| 2013/0220637 | A1 | 8/2013 | Fabela et al. | |
| 2014/0013731 | A1 | 1/2014 | Hallundbæk | |

(Continued)

FOREIGN PATENT DOCUMENTS

WO 2014081957 5/2014

OTHER PUBLICATIONS

Hwang, PCT Written Opinion for PCT Application No. PCT/US14/41683 dated Mar. 27, 2015.

(Continued)

*Primary Examiner* — Brad Harcourt
(74) *Attorney, Agent, or Firm* — Locke Lord LLP

(57) ABSTRACT

A downhole tool anchor is disclosed. In one implementation, a downhole anchor tool may include a housing, an axial drive in the housing, a rack connected to the axial drive, a pinion in the housing, the pinion having teeth that engage teeth on the rack, a gear tube within the pinion, the gear tube having internal threads, a slip rod having external threads that engage the internal threads within the gear tube, and a radial bearing coupled to the gear tube, the radial bearing having a slip rod alignment member that prevents the slip rod from free spinning in the gear tube.

20 Claims, 4 Drawing Sheets

(56) References Cited

U.S. PATENT DOCUMENTS

| | | | | |
|---|---|---|---|---|
| 2014/0014315 | A1 | 1/2014 | Hallundbæk | |
| 2014/0014323 | A1 | 1/2014 | Hallundbæk | |
| 2015/0285043 | A1* | 10/2015 | Airey | E21B 43/129 166/372 |

OTHER PUBLICATIONS

Bakke, Monika, and Geir Magne Berg. "Rolling Anchor System." SPE/ICoTA Coiled Tubing Conference & Exhibition. Society of Petroleum Engineers, 2006.

* cited by examiner

CONSTANT FORCE DOWNHOLE ANCHOR TOOL

TECHNICAL FIELD

The embodiments disclosed herein relate generally to downhole tools for oil and gas wells, and, in particular to devices and methods for anchoring the tools in a wellbore casing section.

BACKGROUND

Downhole tools are often used to provide operations in oil and gas wells. Wirelines or slicklines are used to position downhole tools at a desired location in the wellbore. The desired location in the wellbore may be either cased or uncased, depending on the nature of the operation to be performed by the tool. In order to perform the desired operation, many wireline or slickline tools must be anchored in the wellbore to hold them in the correct wellbore location. This means the anchor must be able to resist not only unwanted movement of the tool in the axial direction, but also rotational movement caused by torque on the tool during the operation.

DETAILED DESCRIPTION OF DISCLOSED EMBODIMENTS

As an initial matter, it will be appreciated that the development of an actual, real commercial application incorporating aspects of the disclosed embodiments will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the disclosure.

Figure 1:
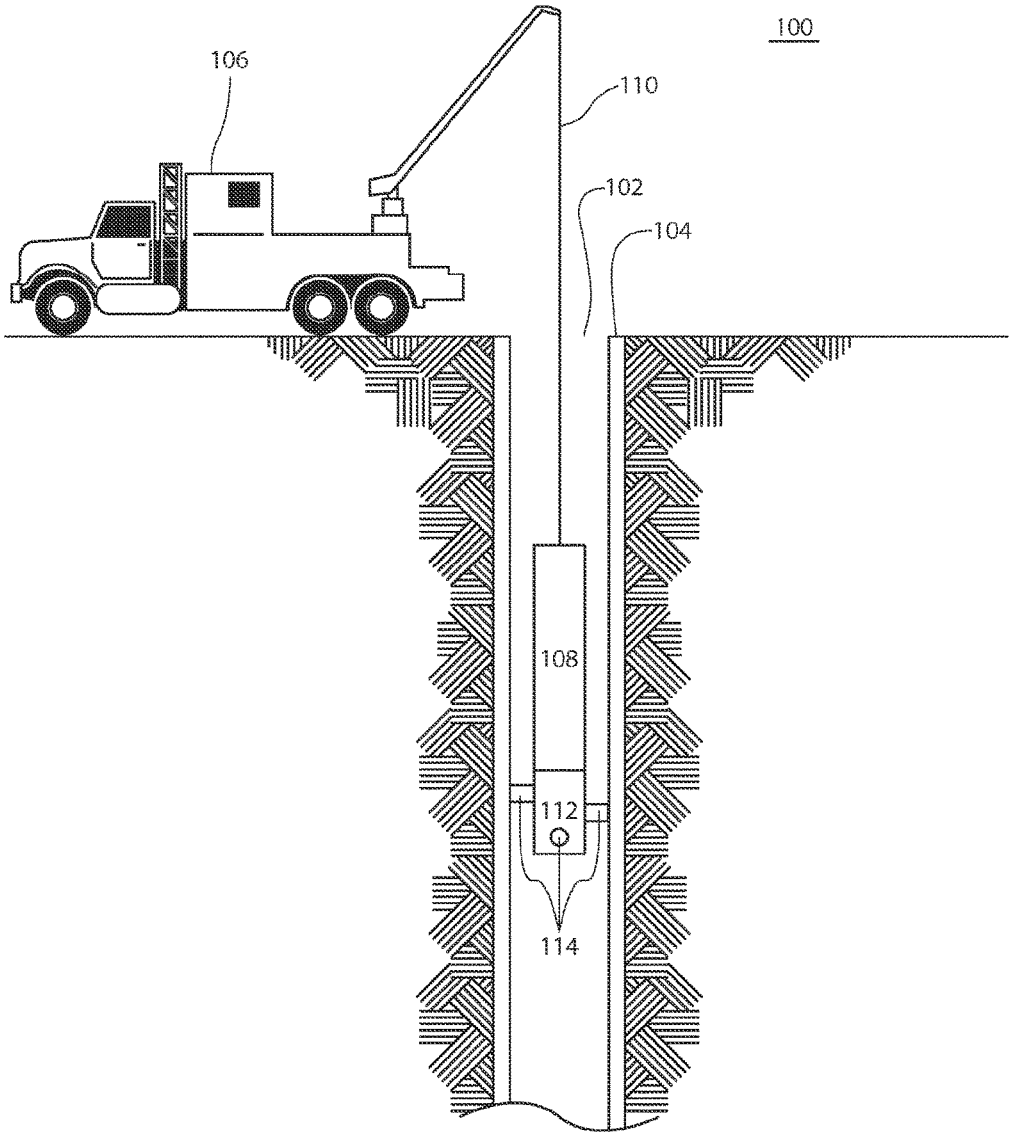
FIG. 1 is a diagram showing a downhole anchoring system according to an embodiment.

In one embodiment of the disclosure, there is provided a downhole anchor for anchoring a downhole tool in a desired section of the wellbore. FIG. 1 shows an anchoring system

100 according to an embodiment of the disclosure. Wellbore 102 of an oil and gas well is lined with casing 104. A wireline truck 106 may be used to deploy activation tool 108 at a desired location within wellbore 102 from wireline 110. Other deployment methods may include slickline, coiled tubing, or jointed tubing. An activation tool can be any type of downhole tool that is activated downhole to perform a desired operation. Examples of actuation tools include any number of well intervention tools, such, as tools for setting packers, washing tools, milling tools, data gathering or sampling tools, and so forth. Generally, any downhole tool that requires anchoring may be used in embodiments of the system. Further, one or more anchors may be provided as necessary to maintain the activation tool in place. Similarly, in other embodiments, more than one activation tool may be included in the work string. For simplicity, in the embodiment depicted in FIG. 1, a single anchor 112 is provided to hold activation tool 108 in place. Anchor 112 includes radially extending slip rods 114 that engage the inner surface of wellbore casing 104 with sufficient force to hold activation tool 108 in place. The end of the slip rods 114 that engages the inner surface of the wellbore may be provided with an engagement surface that increases the grip of the anchor in the wellbore. The engagement surfaces may be provided with, for example, teeth or grooves that help hold the anchor in place when force is applied to the downhole tool. The engagement surface may be integrally formed on the end of the slip rods, or it may be a separate component. It may also be optimized for particular situations, such as whether the wellbore is cased or uncased, or whether the force the anchor is required to resist is expected to be primarily axial or rotational.

Figure 2:
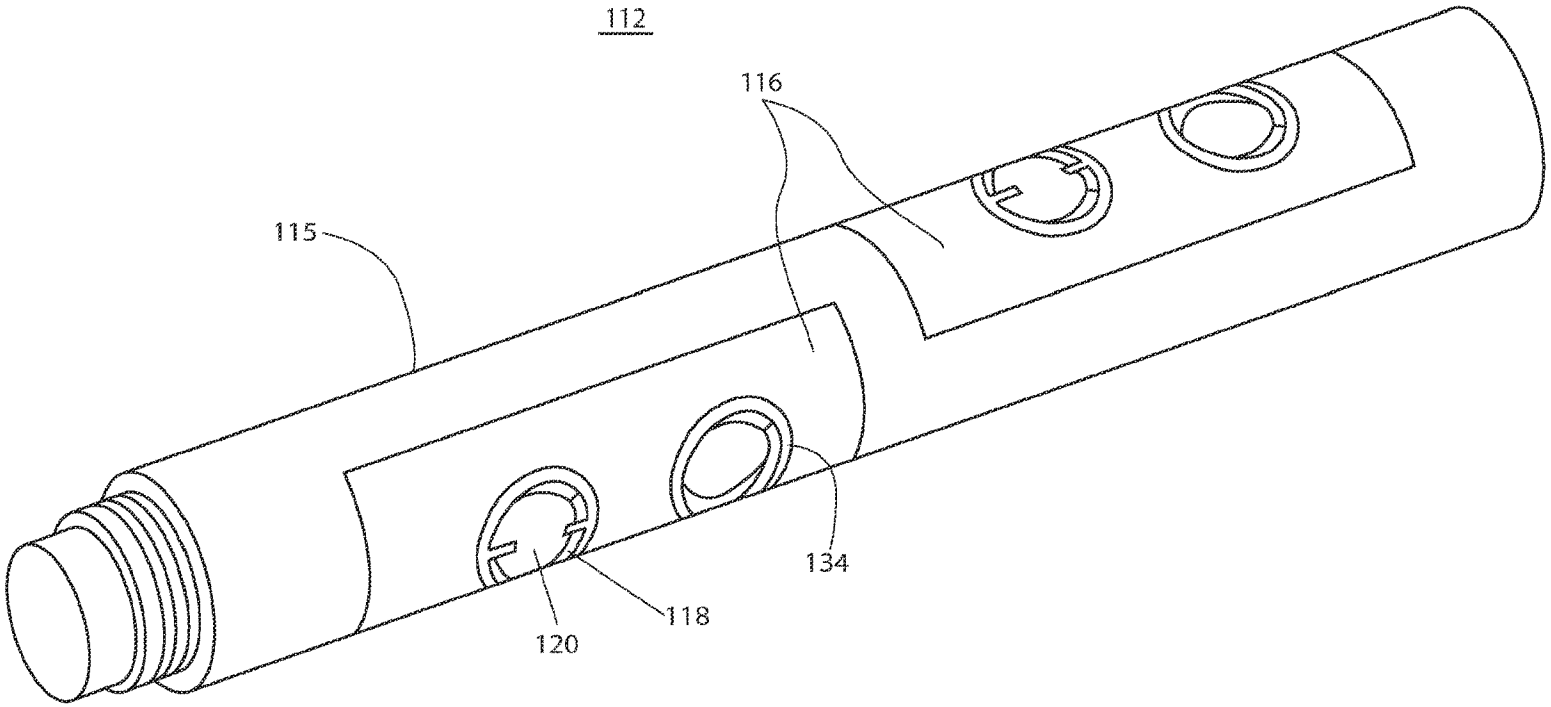
FIG. 2 is a diagram showing a downhole anchor tool according to an embodiment in the run-in-hole position.

FIG. 2 shows an illustration of an example anchor in its initial run-in-hole (RIH) position according to an embodiment of the disclosure. In the RIH position the rods are located inside the anchor body. In the embodiments depicted, the RIH position will be the same as the pull-out-of-hole (POOH) position. In the deployed position, the rods will be extended radially outward from the anchor body. The anchor 112 includes an outer housing 115 having two mechanical compartments 116 that hold the mechanical components used to engage the anchor 112 with the wellbore. An anchor according to the disclosure is not limited to two mechanical compartments, but may have any number of such compartments as a matter of design choice. In the embodiment depicted in FIG. 2, each mechanical compartment 116 houses two slip rods 120, which radially extend from opposite sides (i.e., 180 degrees to each other) from the housing 115. The mechanical compartments are themselves set at 90 degrees from each other so that, when deployed, the slip rods are evenly spaced at 90 degree intervals around the wellbore. This may allow stability and self-centering of the anchor 112 in the wellbore when deployed. The slip rods 120 may be arranged in gear tubes which may be supported by radial and thrust bearings 118 and 134.

Figure 3:
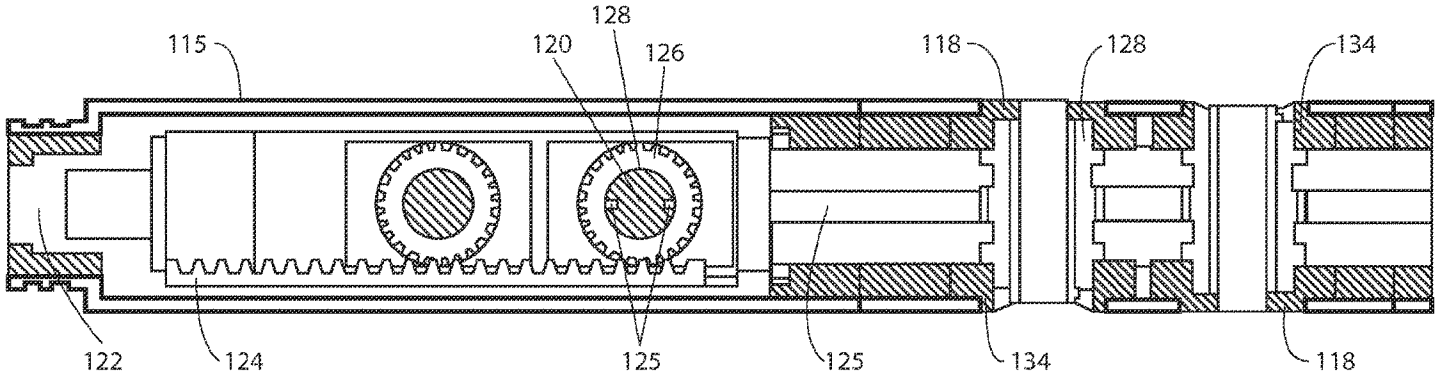
FIG. 3 is a diagram showing a downhole anchor tool according to an embodiment.

FIG. 3 is a diagram schematically illustrating an anchor 112 according to an embodiment of the disclosure. FIG. 3 illustrates the anchor in the RIH position. The main axial drive 122 is arranged to move rack 124 longitudinally inside the housing 115. The main axial drive 122 may be driven hydraulically, electromechanically, or by any other suitable method for moving mechanical components in a downhole tool. The slip rods 120 have external threads and are arranged inside gear tubes 128. Gear tubes 128 have internal threads that mate with the external threads on slip rods 120. Each gear tube 128 is provided with a pinion 126. Pinions 126 engage the teeth on rack 124 so that the linear movement of rack 124 causes pinions 126 to rotate. The linear movement of the rack 124 and the rotational movement of the pinions 126 is bi-directional. This allows the slip rods 120 to be extended from and retracted into the housing 115 by the linear movement of the main axial drive 122.

Figure 4:
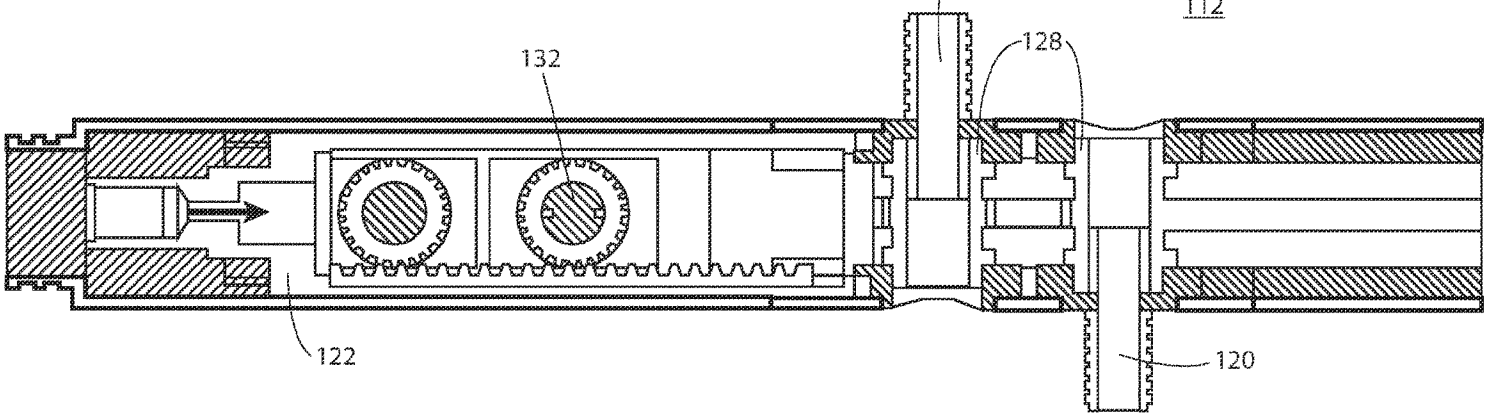
FIG. 4 is a diagram showing a downhole anchor tool according to an embodiment.

FIG. 4 is a diagram schematically illustrating an anchor 112 according to an embodiment after it has been actuated. To actuate, the main axial drive 122 is driven toward the pinions 126 in the direction indicated by the reference arrow. The linear movement of the main axial drive 122 rotates the pinions 126, which, in turn, rotate gear tubes 128. To ensure the slip rods 120 are radially extended by the rotation of the gear tubes 128, rather than simply free spinning, the radial and thrust bearings 118 may be provided with a slip rod alignment member or projection, such as ribs 130, which extend into a corresponding grooves or channels 132 formed lengthwise on the corresponding slip rod 120. Although two opposing ribs are depicted, other embodiments may use any number of ribs, and the ribs may be provided on a separate component from the bearing, for example, a separate washer having internally projecting ribs, or even formed on the housing or a cover plate on the mechanical compartment.

At least one end of the gear tubes 128 may be coupled to a radial and thrust bearing, such as radial and thrust bearings 134. The bearings provide radial support for free rotation of gear tubes 128 within housing and also provide thrust support for the rods during anchoring. In one embodiment of the disclosure, the threads of the adjacent pairs of gear tubes and slips rods may be reversed, e.g., right handed versus left handed, so that the slip rods move in opposite directions in response to the linear motion of the main axial drive. In some embodiments, the threads on a set of rods may have the same thread configuration, e.g., both right handed, if more support is needed on one side. They may also be opposite threaded (as shown in the figures) for stability. This allows the slip rods to engage opposite sides of the casing for stability.

Figure 5:
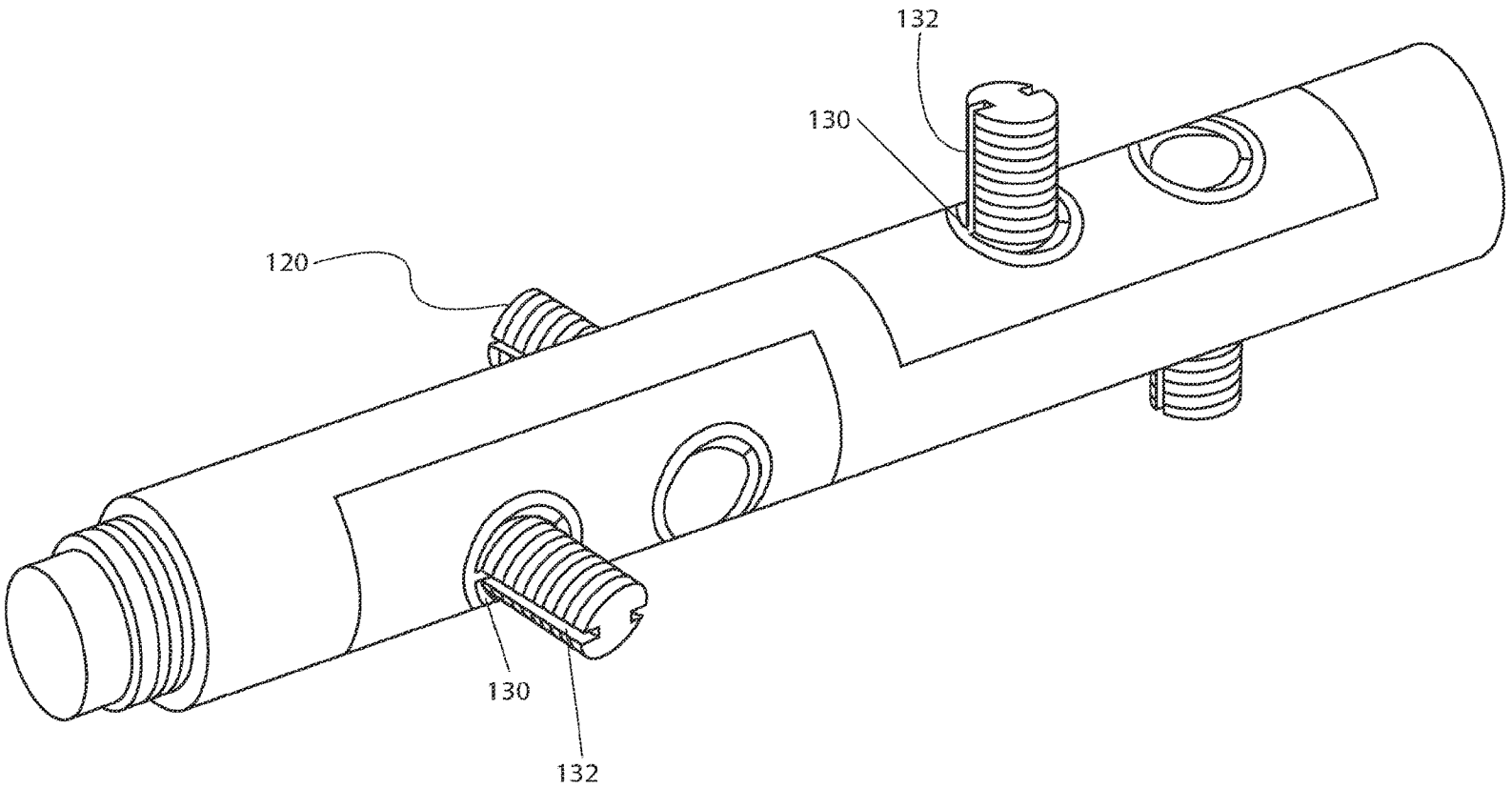
FIG. 5 is a diagram showing a downhole anchor tool according to an embodiment.

FIG. 5 is a diagram illustrating an embodiment of the disclosure having two pairs of slip rods 120 for engaging the wellbore casing. Although pairs of slip rods are depicted, in some embodiments, individual rods may be provided for some applications as a matter of design choice so that the rods do not necessarily have to be in a symmetrical configuration. The embodiment depicted shows a downhole anchor in the fully deployed position. Each pair is housed in a separate mechanical compartment. Within each pair of slip rods 120, each slip rod radially extends in the opposite direction from the other. The pairs of slip rods are arranged at ninety degree intervals so that the engagement force for the downhole anchor is evenly distributed around the wellbore. This may provide stability and self-centering of the downhole anchor. In other embodiments, the pairs of slip rods are not necessarily at an angle of 90 degrees to each other, but may be set at any angle so that multiple sets provide good circumferential coverage and centralization. Referring again to FIG. 4, the main axial drive 122 has a rack 124 and another rack 125, which is offset by ninety degrees from rack 124, to drive the second pair of pinions in the second mechanical compartment. Once the wellbore operation requiring anchoring is complete, then the main axial drive 122 is moved in the opposite direction using, for example, hydraulic or electromechanical methods, which causes the slip rods 120 to retract into the housing 115. The anchor according to the disclosure may then be re-positioned or removed from the wellbore.

In one or more embodiments of the disclosure, a downhole tool anchor may include a housing, an axial drive in the housing, a rack connected to the axial drive, a pinion in the housing, the pinion having teeth that engage teeth on the rack, a gear tube connected to the pinion, the gear tube having internal threads, a slip rod having external threads that engage the internal threads within the gear tube, and a bearing coupled to the gear tube, the bearing may have a slip rod alignment member that prevents the slip rod from free spinning in the gear tube.

In some embodiments, the downhole tool anchor may further comprise any one of the following features individually or any two or more of these features in combination: (a) a second slip rod and a second gear tube having oppositely handed threads from the first slip rod and gear tube, (b) wherein the first and second slip rods and gear tubes are arranged in pairs within a mechanical compartment in the downhole tool anchor at opposite radial extension angles, (c) wherein the slip rod alignment member comprises a projection that engages a channel running along the length of the slip rod, (d) a radial and thrust bearing arranged at one end of the gear tube, (e) wherein the axial drive is hydraulically driven in an axial direction of the downhole tool anchor, and (f) wherein the axial drive is electromechanically driven in an axial direction of the downhole tool anchor.

In one or more embodiments, a method is disclosed for anchoring a downhole tool in a wellbore. The method may comprise positioning a downhole anchor at a location in the wellbore, the anchor may include a housing, an axial drive in the housing, a rack connected to the axial drive, and a pinion in the housing. The pinion may have teeth that engage teeth on the rack, and a gear tube within the pinion. The gear tube may have internal threads, a slip rod having external threads that engage the internal threads within the gear tube, and a bearing coupled to the gear tube. The bearing may have a slip rod alignment member that prevents the slip rod from free spinning in the gear tube.

In some embodiments, the method may further comprise any one of the following features individually or any two or more of these features in combination: (a) moving the axial drive in an axial direction within the casing, causing the pinion to rotate, extending the slip rod radially outward from the housing until an end of the slip rod engages an inner surface of the wellbore casing, (b) simultaneously extending a second slip rod in an opposite radial direction with the first slip rod, (c) wherein the first and second slip rods extended in pairs from within a mechanical compartment in the downhole tool anchor, (d) extending the slip rod through an alignment member having a projection that engages a channel running along the length of the rod, (e) rotating the gear tube against a radial and thrust bearing arranged at one end of the gear tube, (f) hydraulically driving the axial drive in an axial direction of the downhole anchor, and (g) electromechanically driving the axial drive in an axial direction of the downhole anchor.

In one or more embodiments a system for anchoring tools in wellbore is disclosed. The system may comprise a downhole tool having a housing, an axial drive in the housing, a rack connected to the axial drive that is connected to a pinion, wherein the pinion is coupled to a gear tube having internal threads that mate with external threads on a slip rod, the gear tube being coupled to a bearing, the bearing may have a slip rod alignment member that prevents the slip rod from free spinning in the gear tube.

In some embodiments, the system may further comprise any one of the following features individually or any two or more of these features in combination: (a) a second slip rod and a second gear tube having oppositely handed threads from the first slip rod and gear tube, (b) the first and second slip rods and gear tubes are arranged in pairs within a mechanical compartment in the downhole tool anchor at opposite radial extension angles, (c) the slip rod alignment member comprises a projection that engages a channel running along the length of the slip rod a radial and thrust bearing arranged at one end of the gear tube, and (d) wherein the axial drive is hydraulically or electromechanically driven in an axial direction of the downhole tool anchor.

While the disclosed embodiments have been described with reference to one or more particular implementations, those skilled in the art will recognize that many changes may be made thereto without departing from the spirit and scope of the description. Accordingly, each of these embodiments and obvious variations thereof is contemplated as falling within the spirit and scope of the following claims.

What is claimed is:

1. A downhole tool anchor comprising:

a housing;

an axial drive in the housing;

a rack connected to the axial drive;

a pinion in the housing, the pinion having teeth that engage teeth on the rack;

a gear tube connected to the pinion, the gear tube having internal threads; and a slip rod having external threads that engage the internal threads within the gear tube and having a wellbore engagement surface at an end of the slip rod;

a bearing coupled to the gear tube; and a slip rod alignment member that prevents the slip rod from free spinning in the gear tube.

2. A downhole tool anchor as in claim 1 further comprising a second slip rod and a second gear tube having oppositely handed threads from the first slip rod and gear tube.

3. A downhole tool anchor as in claim 2 wherein the first and second slip rods and gear tubes are arranged in pairs within a mechanical compartment in the downhole tool anchor at opposite radial extension angles.

4. A downhole tool anchor as in claim 1 wherein the slip rod alignment member comprises a projection that engages a channel running along the length of the slip rod.

5. A downhole tool anchor as in claim 1 further comprising a radial and thrust bearing arranged at an end of the gear tube.

6. A downhole tool anchor as in claim 1 wherein the axial drive is hydraulically driven in an axial direction of the downhole tool anchor.

7. A downhole tool anchor as in claim 1 wherein the axial drive is electromechanically driven in an axial direction of the downhole tool anchor.

8. A method for anchoring a downhole tool in a wellbore, the method comprising:

positioning a downhole anchor at a location in the wellbore, the anchor including a housing, an axial drive in the housing, a rack connected to the axial drive, a pinion in the housing, the pinion having teeth that engage teeth on the rack, a gear tube connected to the pinion, the gear tube having internal threads, a slip rod having external threads that engage the internal threads within the gear tube and having a wellbore engagement surface at an end of the slip rod, a bearing coupled to the gear tube, and a slip rod alignment member that prevents the slip rod from free spinning in the gear tube;

moving the axial drive in an axial direction within the housing, causing the pinion to rotate;

extending the slip rod radially outward from the housing until an end of the slip rod engages an inner surface of the wellbore casing.

9. A method as in claim 8 further comprising simultaneously extending a second slip rod in an opposite radial direction with the first slip rod.

10. A method as in claim 9 wherein the first and second slip rods are extended in pairs from within a mechanical compartment in the downhole tool anchor.

11. A method as in claim 8 further comprising extending the slip rod through an alignment member having a projection that engages a channel running along the length of the rod.

12. A method as in claim 8 further comprising rotating the gear tube against a radial and thrust bearing arranged at one end of the gear tube.

13. A method as in claim 8 further comprising hydraulically driving the axial drive in an axial direction of the downhole anchor.

14. A method as in claim 8 further comprising electromechanically driving the axial drive in an axial direction of the downhole anchor.

15. A system for anchoring tools in wellbore, the system comprising:

a downhole tool having a housing, an axial drive in the housing, a rack connected to the axial drive that is connected to a pinion;

wherein the pinion is coupled to a gear tube having internal threads that mate with external threads on a slip rod having a wellbore engagement surface at an end, the gear tube being coupled to a bearing, the downhole tool also having a slip rod alignment member that prevents the slip rod from free spinning in the gear tube.

16. A system as in claim 15 further comprising a second slip rod and a second gear tube having oppositely handed threads from the first slip rod and gear tube.

17. A system as in claim 16 wherein the first and second slip rods and gear tubes are arranged in pairs within a mechanical compartment in the downhole tool anchor at opposite radial extension angles.

18. A system as in claim 15 wherein the slip rod alignment member comprises a projection that engages a channel running along the length of the slip rod.

19. A system as in claim 15 further comprising a radial and thrust bearing arranged at an end of the gear tube.

20. A system as in claim 15 wherein the axial drive is hydraulically or electromechanically driven in an axial direction of the downhole tool anchor.

* * * * *